US008083930B2

(12) United States Patent
McCoy et al.

(10) Patent No.: US 8,083,930 B2
(45) **Date of Patent: *Dec. 27, 2011**

(54) VPS TAR SEPARATION

(75) Inventors: James N. McCoy, Houston, TX (US); Paul F. Keusenkothen, Houston, TX (US); Alok Srivastava, Allsworth Park (SG); James E Graham, Baytown, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 442 days.

This patent is subject to a terminal disclaimer.

(21) Appl. No.: 11/880,983

(22) Filed: Jul. 25, 2007

(65) Prior Publication Data

US 2008/0053869 A1 Mar. 6, 2008

Related U.S. Application Data

(60) Provisional application No. 60/841,597, filed on Aug. 31, 2006.

(51) Int. Cl.
*C10C 1/04* (2006.01)
*C10C 1/14* (2006.01)
*C10G 9/36* (2006.01)

(52) U.S. Cl. ..... 208/42; 208/130; 208/309; 208/347; 208/361

(58) Field of Classification Search ..... 196/125, 196/136; 202/197, 267, 268, 270; 203/11, 203/40, 73; 208/347, 350, 352, 366, 309, 208/361, 367, 41, 42, 130
See application file for complete search history.

(56) References Cited

U.S. PATENT DOCUMENTS

| | | | |
|---|---|---|---|
| 3,413,211 | A | 11/1968 | Becraft et al. |
| 3,501,400 | A | 3/1970 | Brody |
| 3,617,493 | A | 11/1971 | Wirth et al. |
| 3,622,502 | A | 11/1971 | Mason et al. |
| 3,691,058 | A | 9/1972 | Hamner et al. |
| 3,707,459 | A | 12/1972 | Mason et al. |
| 3,941,681 | A | 3/1976 | Saegusa et al. |
| 3,956,101 | A | 5/1976 | Hara et al. |
| 3,998,726 | A | 12/1976 | Bunas et al. |
| 4,086,156 | A | 4/1978 | Dickakian |
| 4,140,212 | A | 2/1979 | O'Blasny et al. |
| 4,207,168 | A | 6/1980 | Simone |
| 4,219,404 | A | 8/1980 | Dickakian |

(Continued)

FOREIGN PATENT DOCUMENTS

| | | |
|---|---|---|
| BE | 889974 | 1/1981 |

(Continued)

OTHER PUBLICATIONS

Van Dongen et al.; "The Application of Gas/Liquid Cyclones in Oil Refining"; Jan. 1958; Transactions of the ASME; pp. 245-251.

*Primary Examiner* — Walter D Griffin
*Assistant Examiner* — Renee E Robinson

(57) ABSTRACT

A process is described for producing deasphalted steam cracker tar comprising feeding steam cracker tar to a vacuum pipestill (VPS) including a flash zone separated from a zone comprising trays by at least one annular entrainment ring and obtaining as an overheads a deasphalted tar product and as a bottoms an asphaltenic heavy tar product. Also according to the invention, there is a system for the upgrading of tar comprising said VPS with at least one annular entrainment ring.

15 Claims, 1 Drawing Sheet

U.S. PATENT DOCUMENTS

| | | | | |
|---|---|---|---|---|
| 4,261,814 | A | 4/1981 | Pfeifer | |
| 4,264,334 | A | 4/1981 | Durand et al. | |
| 4,309,271 | A | 1/1982 | Dorner | |
| 4,363,715 | A | 12/1982 | Dickakian | |
| 4,414,095 | A | 11/1983 | Dickakian | |
| 4,431,512 | A | 2/1984 | Dickakian | |
| 4,435,274 | A | 3/1984 | Juguin et al. | |
| 4,446,002 | A | 5/1984 | Siegmund | |
| 4,548,704 | A | 10/1985 | Dickakian | |
| 4,705,618 | A | 11/1987 | Tsuchitani et al. | |
| 4,721,557 | A | 1/1988 | Staggs | |
| 4,770,747 | A * | 9/1988 | Muller | 202/176 |
| 5,215,649 | A | 6/1993 | Grenoble et al. | |
| 5,358,627 | A | 10/1994 | Mears et al. | |
| 5,443,715 | A | 8/1995 | Grenoble et al. | |
| 5,489,374 | A | 2/1996 | Romine et al. | |
| 5,785,860 | A | 7/1998 | Smith | |
| 5,976,361 | A | 11/1999 | Hood et al. | |
| 6,241,874 | B1 | 6/2001 | Wallace et al. | |
| 6,533,925 | B1 | 3/2003 | Wallace et al. | |
| 6,632,351 | B1 | 10/2003 | Ngan et al. | |
| 7,311,746 | B2 | 12/2007 | Stell et al. | |
| 7,560,020 | B2 | 7/2009 | Annamalai et al. | |
| 7,713,636 | B2 | 5/2010 | Song et al. | |
| 2004/0232047 | A1 | 11/2004 | Benazzi et al. | |
| 2005/0261530 | A1 * | 11/2005 | Stell et al. | 585/648 |
| 2006/0272982 | A1 | 12/2006 | Montanari et al. | |
| 2007/0007170 | A1 | 1/2007 | Strack et al. | |
| 2008/0116109 | A1 | 5/2008 | McCoy et al. | |

FOREIGN PATENT DOCUMENTS

| | | |
|---|---|---|
| CA | 1069846 | 1/1980 |
| DE | 3227490 | 7/1987 |
| EP | 0021708 | 1/1981 |
| EP | 0056338 | 7/1982 |
| EP | 0086607 | 8/1983 |
| EP | 0100198 | 2/1984 |
| EP | 0067581 | 11/1985 |
| EP | 0 250 136 | 12/1987 |
| EP | 0243509 | 8/1990 |
| EP | 0791040 | 8/1997 |
| FR | 2510133 | 1/1983 |
| GB | 1 298 098 | 11/1972 |
| GB | 2014605 | 8/1979 |
| GB | 1601644 | 11/1981 |
| GB | 2104544 | 3/1983 |
| JP | 52-81321 | 7/1977 |
| JP | 58-149991 | 9/1983 |
| JP | 61-98794 | 5/1986 |
| WO | 91/13951 | 9/1991 |
| WO | 91/17230 | 11/1991 |
| WO | 93/12200 | 6/1993 |
| WO | 2006/066857 | 6/2006 |

* cited by examiner

VPS TAR SEPARATION

RELATED APPLICATIONS

This application claims benefit of and priority to U.S. provisional patent application Ser. No. 60/841,597 (2006EM094), filed Aug. 31, 2006, the entirety of which is incorporated herein by reference.

FIELD OF THE INVENTION

The invention relates to upgrading of tar (pyrolysis fuel oil) to produce deasphalted tar from steam cracked tar.

BACKGROUND OF THE INVENTION

Steam cracking, also referred to as pyrolysis, has long been used to crack various hydrocarbon feedstocks into olefins. Conventional steam cracking utilizes a pyrolysis furnace wherein the feedstock, typically comprising crude or a fraction thereof optionally desalted, is heated sufficiently to cause thermal decomposition of the larger molecules. Steam is typically added to the pyrolysis furnace inter alia to reduce hydrocarbon partial pressure, to control residence time, and to minimize coke formation. Among the valuable and desirable products obtained from the furnace include light olefins such as ethylene, propylene, and butylenes. The pyrolysis process, however, also produces molecules that tend to combine to form high molecular weight materials known as steam cracked tar or steam cracker tar ("SCT"), sometimes referred to as pyrolysis fuel oil. Typically tar, as well as steam cracked gas oil ("SCGO") is recovered as bottoms product in the first fractionator after the steam cracker. These are among the least valuable products obtained from the effluent of a pyrolysis furnace. In general, feedstocks containing higher aromatic boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are very high in molecular weight and precipitate out when blended in even insignificant amounts into other materials, such as fuel oil streams.

The increasing use of lower quality crude feeds to the refinery, i.e., heavier, and more aromatic and/or higher sulfur feeds, has increased the amount of tar produced and, in the case of higher sulfur feeds, increased the difficulty of disposing of it. While tar has always been difficult to dispose of, the tar obtained from these heavy and/or high sulfur feeds is less compatible with refinery fuel oil pools and the typically higher sulfur levels render it unacceptable for burning.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

Methods of upgrading tar have been proposed in the prior art, but these methods are inefficient and/or do not provide sufficient volume of disposal of low value tar. For instance, U.S. Pat. No. 4,207,168 teaches making needle coke from pyrolysis fuel oil by separating quinoline insolubles and asphaltenes from the fuel oil and subjecting the remaining portion to coking.

GB 2 014 605 discloses a method of treating the pyrolysis fuel oil hydrocarbon fraction boiling at above 200° C. to solvent extraction to remove insoluble polymeric compounds. The polymer-free portion is said to be useful as fuel oil.

In the disclosure of U.S. Pat. No. 4,309,271, hydrocarbons are subjected to hydrogenation and, after separation of the product into liquid and gaseous fractions, the liquid fraction is cracked and fractionated. A polymer free fraction of the residue is returned to the feedstock and to the hydrogenation stage, and a heavy residue component of the initial liquid fraction partially oxidized with the residue.

GB 2 104 544 discloses treating pyrolysis tar obtained from the production of ethylene from naphtha feeds via steam cracking by first heating the feedstock with hydrogen to saturate polynuclear aromatic compounds, then hydrocracking the hydrogenated compounds in a cracking zone to obtain an effluent from the cracking zone which may be separated into a gaseous and liquid product.

U.S. Pat. No. 4,548,704 relates to making pitch suitable for spinning into carbon fibers, the pitch being derived from a deasphaltenated middle fraction of a feedstock.

Despite these advances, there remains a problem that SCT continues to be generated in amounts beyond the capacity of current technology to be efficiently utilized. Thus, significant amounts of SCT must be disposed of by adding to fuel oil pools or simply local combustion to generate, for example, steam. However, steam cracker tar, even relatively low asphaltene steam cracker tar, is generally incompatible with fuel oil pools such as Bunker C fuel oil. Onsite tar burning in site boilers is then preferred to avoid tar separation investment, but tighter emission regulations increasingly limit the amount that can be burned for this purpose.

Since at least the early 1980s, the bottoms of the primary fractionator downstream of a pyrolysis furnace has been fed to a vacuum tower or vacuum pipestill ("VPS"), resulting in the production of a heavy tar asphaltenic product as bottoms of the VPS. However, the quantity of this heavy tar asphaltenic product was very small and could be disposed of by blending, optionally with a fluxant, into various fuel oil pools such as Bunker fuels, or by local combustion to generate steam. However, SCT is now being generated in amounts beyond the capacity of current technology to be efficiently utilized, because of the general incompatibility of steam cracker tar, even relatively low asphaltene steam cracker tar, with fuel oil pools. Onsite tar burning in site boilers, an alternative to blending used to avoid tar separation investment, is generally precluded by tighter emission regulations increasingly limit the amount that can be burned for this purpose.

A gas/liquid "cyclone" separator was described by Van Dongen and Ter Linden for oil refining in Transactions of the ASME, January 1958, pp. 245-251.

In U.S. Pat. No. 4,140,212, a distillation tower is described including a tangential inlet and cooperating internal baffles for creating a whirling flow pattern, with a means for recovery of hydrocarbons from waste oil introduced to the tower through the tangential inlet.

The present inventors have discovered that feeding tar from a pyrolysis furnace to a vacuum pipestill equipped with an annular ring device such as the entrainment devices taught in the aforementioned ASME article and/or U.S. Pat. No. 4,140,212, to minimize entrainment of liquid in the vapor phase going overhead provides an efficient method of reducing or eliminating the problem of disposal of steam cracker tar.

SUMMARY OF THE INVENTION

The invention is directed to a process wherein a feedstock comprising steam cracker tar is passed to the flash zone of a vacuum pipestill equipped with at least one annular entrainment ring separating the flash zone from the pipestill distillation zone (e.g., a zone comprising distillation trays) and obtaining as a product an overheads (and/or sidestream) comprising a deasphalted cut of tar and a heavy tar asphaltenic product as bottoms. The at least one annular ring decreases or minimizes entrainment of liquid in the vapor phase going overhead. All or at least a portion of the bottoms product may be efficiently utilized by sending it to a POX and/or coker unit. Alternatively or in addition, all or at least a portion of the bottoms product may be efficiently used by blending with refinery fuel pools without compatibility problems.

In preferred embodiments, at least a portion of the bottoms product is used to produce syn gas in a partial oxidation unit (POX) and/or at least a portion of the bottoms product is used to produce a light product stream in a coker unit, such as coker naphtha and/or or coker gas oil. In another preferred embodiment at least a portion of the overheads product is added to refinery fuel oil pools and/or at least a portion of the overheads product is mixed with locally combusted materials to lower soot make.

In yet another preferred embodiment the stream comprising steam cracker tar is introduced tangentially into the cylinder of the pipestill and the vapor phase is removed overhead via a smaller inner cylinder.

The invention is also directed to an integrated system comprising a pyrolysis furnace wherein the bottoms product from the primary fractionator downstream from the pyrolysis furnace is passed to a vacuum pipestill whereby steam cracker tar is separated in said vacuum pipestill into a deasphalted that overheads and a heavy tar asphaltenic bottoms product, and which in more preferred embodiments is integrated with POX and/or coker units.

It is an object of the invention to upgrade tar fractions by at least one of the use of a vacuum tower optionally equipped with annular entrainment rings and disposition of at least a portion of the vacuum tower bottoms to a POX and/or coker unit.

It is another object of the invention to decrease the amount of low value tar product of steam cracker processes used to produce light olefins such as ethylene, propylene, butylene and the like., i.e., decrease the amount of tar which must be disposed of in low value uses, by separating out higher value products, e.g., deasphalted tar, leaving a relatively smaller quantity of low value product (e.g., coke) to be disposed of.

These and other objects, features, and advantages will become apparent as reference is made to the following detailed description, preferred embodiments, examples, and appended claims.

BRIEF DESCRIPTION OF THE DRAWINGS

In the accompanying drawings, like reference numerals are used to denote like parts throughout the several views.

DETAILED DESCRIPTION

Figure 1:
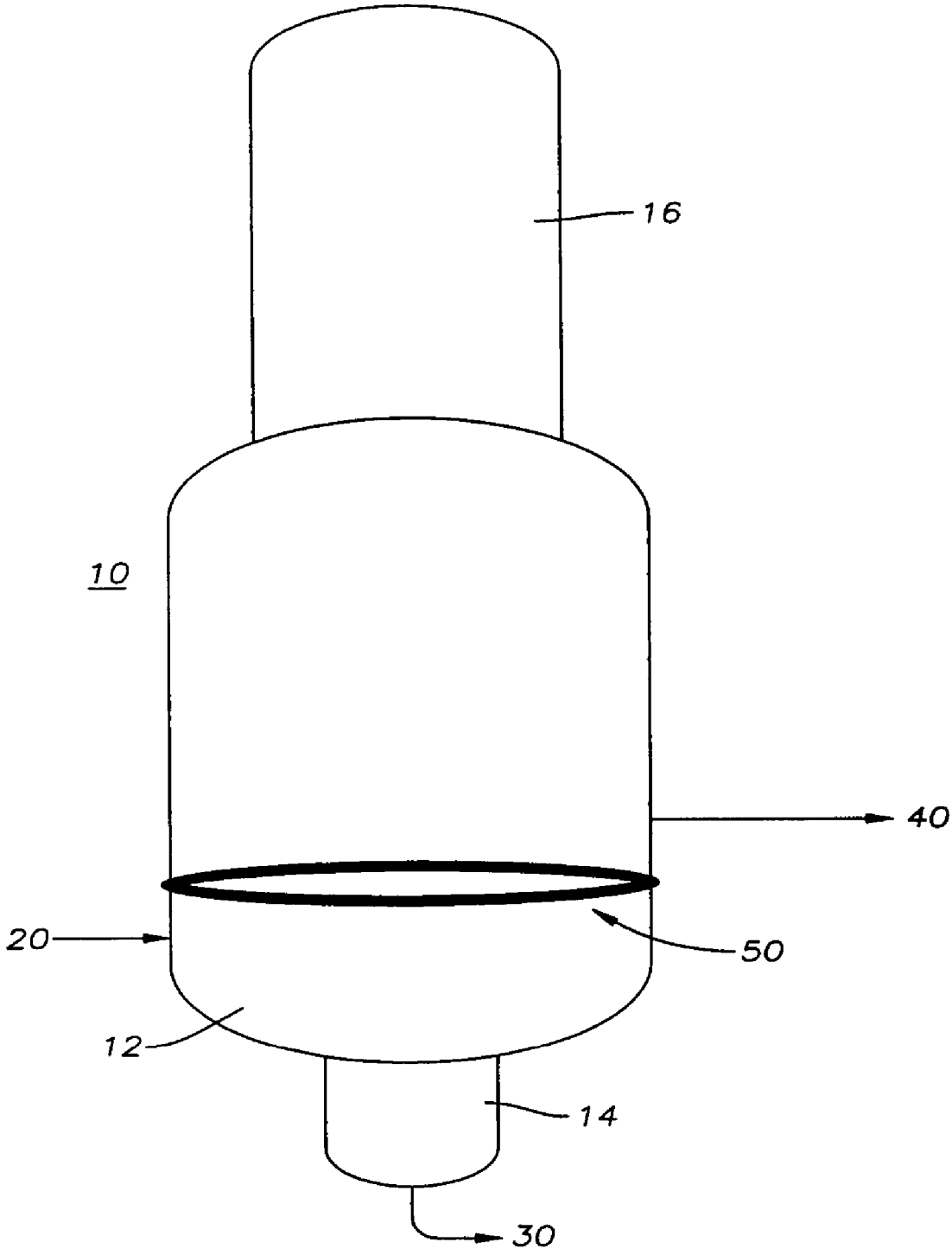
FIGS. 1 is a process flow diagrams illustrating a preferred embodiment of the present invention.

The invention is a process for producing deasphalted steam cracker tar comprising feeding steam cracker tar to a vacuum pipestill (VPS) including a flash zone separated from a distillation zone or zone comprising distillation trays by at least one annular ring and obtaining as an overheads a deasphalted tar product and as a bottoms an asphaltenic heavy tar product.

Also according to the invention, there is a system for the upgrading of tar comprising, in series, a pyrolysis furnace fluidly connect with a primary fractionator whereby tar is obtained as a bottoms product, and a vacuum pipestill equipped with an annular entrainment device as hereinafter described. Optionally, downstream of the vacuum pipestill, is a POX and/or coker unit.

Crude, as used herein, means whole crude oil as it issues from a wellhead, optionally including a step of desalting and/or other steps as may be necessary to render it acceptable for conventional distillation in a refinery. Crude as used herein is presumed to contain resid unless otherwise specified.

The terms thermal pyrolysis unit, pyrolysis unit, steam cracker and steamcracker are used synonymously herein; all refer to what is conventionally known as a steam cracker, even though steam is optional.

The term vacuum pipestill (or vacuum pipe still), vacuum tower, and "VPS" are also used synonymously herein, and include apparatus per se well known in refining operations.

The term "POX" means a partial oxidation and POX unit as used herein refers to the apparatus within which the partial oxidation occurs. The term "coking" or "delayed coking" refers to a thermal cracking process by which a heavy material is converted into lighter material and coke and the coking unit refers to the apparatus within which the coking occurs. Both process and apparatus terms are well known per se in refining.

In a preferred embodiment of the present invention, optional partial oxidation reacts at least a portion of the hydrocarbon feed from the vacuum pipestill equipped with the annular entrainment ring with oxygen at high temperatures to produce a mixture of hydrogen and carbon monoxide (Syn Gas). While the conditions of partial oxidation are not critical and can be determined by one of ordinary skill in the art, for the present invention preferred conditions include a temperature of about 1455° C. (±50° C.) and pressure of about 870 psig (±25 psig), measured at the reactor inlet. The $H_2$ and CO yields will vary according to conditions but in preferred embodiments will be in the range of about 0.98 to 1.8 $H_2$/CO, which may be achieved without undue experimentation by one of ordinary skill in the art in possession of the present disclosure. The Syn Gas is preferably used to make alcohols in integration with the well-known Oxo Process, or to make fuel, or to make a hydrogen rich product, or a combination of these uses.

In another embodiment of the present invention, optional coking in the coker unit converts at least a portion of the hydrocarbon feed from the vacuum pipestill equipped with the annular entrainment ring to coker naphtha and coker gas oil as overheads/sidestreams and coke as a bottoms product. In the present invention, the apparatus used may be a typical coker used in refinery processing, which in refining process converts residual oil from the crude unit vacuum or atmospheric column into gas oil. The process of coking or delayed coking is a semi-continuous thermal cracking process which can be broken down to three distinct stages. The feed undergoes partial vaporization and mild cracking as it passes through the coking furnace. The vapours undergo cracking as they pass through the coke drum to fractionation facilities downstream. In a refinery the typical products of gas, naphtha, jet fuel and gas oil are separated in the fractionation facilities. According to the present invention, the products comprise coker naphtha and coker gas oil separated in the fractionation facilities; the petroleum coke remains in the drum. The heavy hydrocarbon liquid trapped in the coke drum is subjected to successive cracking and polymerization until it is converted to vapours and coke.

While appropriate coker conditions may be determined without undue experimentation by one of ordinary skill in the art in possession of the present disclosure, preferred conditions include a temperature of about 450° C. to 550° C. and pressure of about 15-25 psig, measured at the reactor inlet. Coke resulting from a low sulfur feed may be used for needle coke or anode coke. More generally, the coke produced by the process of the invention may be used for fuel.

"Tar" or steam cracker tar (SCT) as used herein is also referred to in the art as "pyrolysis fuel oil". The terms will be used interchangeably herein. The tar will typically be obtained from the first fractionator downstream from a steam cracker (pyrolysis furnace) as the bottoms product of the fractionator, nominally having a boiling point of 550° F.+ (288° C.+) and higher.

In a preferred embodiment, SCT is obtained as a product of a pyrolysis furnace wherein additional products include a vapor phase including ethylene, propylene, butenes, and a liquid phase comprising C5+ species, having a liquid product distilled in a primary fractionation step to yield an overheads comprising steam-cracked naphtha fraction (e.g., C5-C10 species) and steam cracked gas oil (SCGO) fraction (i.e., a boiling range of about 400° F to 550° F, e.g., C10-C15/C17 species), and a bottoms fraction comprising SCT and having a boiling range above about 550° F, e.g., C15/C17+ species).

The term "asphaltene" as used herein means a material obtainable from crude oil and having an initial boiling point above 1200° F. (650° C.) and which is insoluble in a paraffinic solvent.

The feed to the pyrolysis furnace may comprise crude (such as a high sulfur containing virgin crude rich in polycyclic aromatics which has been desalted), or a crude fraction thereof (such as may be obtained from an atmospheric pipestill (APS) or vacuum pipestill (VPS) of a type per se well-known in the art, or typically a combination of APS followed by VPS treatment of the APS bottoms). Additional advantaged feeds are discussed elsewhere herein. The crude and/or fraction thereof are optionally but preferably desalted prior to being provided to the pyrolysis furnace. In general the operating conditions of such a furnace, which may be a typical pyrolysis furnace such as known per se in the art, can be determined by one of ordinary skill in the art in possession of the present disclosure without more than routine experimentation. Typical conditions will include a radiant outlet temperature of between 760° C.-880° C., a cracking residence time period of 0.01 to 1 sec, and a steam dilution of 0.2 to 4.0 kg steam per kg hydrocarbon.

It is preferred that the furnace have a vapor/liquid separation device (sometimes referred to as flash pot or flash drum) integrated therewith, such as disclosed and described in U.S. Patent Applications 2004/0004022; 2004/0004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. Another preferred vapor/liquid separation device is described in U.S. Pat. No. 6,632,351. In a preferred embodiment using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

In embodiments using a vapor/liquid separation device integrated with the pyrolysis furnace, a feedstream is provided to the inlet of a convection section of a pyrolysis unit, wherein it is heated so that at least a portion of the feedstream is in the vapor phase. Steam is optionally but preferably added in this section and mixed with the feedstream. The heated feedstream with optional steam and comprising a vapor phase and a liquid phase is then flashed in the vapor/liquid separation device to drop out the heaviest fraction (e.g., asphaltenes). In still more preferred embodiments the vapor/liquid separation device integrated with the pyrolysis furnace operates at a temperature of from about 800° F. (about 425° C.) to about 850° F. (about 455° C.). The overheads from the vapor/liquid separation device are then introduced via crossover piping into the radiant section where the overheads are quickly heated, such as at pressures ranging from about 10 to 30 psig, to a severe hydrocarbon cracking temperature, such as in the range of from about 1450° F. to 1550° F., to provide cracking of the feedstream.

The feed comprising crude or fraction thereof is converted in the pyrolysis furnace, optionally having a vapor/liquid separator as described above, at an elevated temperature to cracked products. The hot cracked gas may be quenched or passed at substantially the elevated temperature of the furnace into a pyrolysis fractionating column, also referred to as the first or primary fractionator or fractionating column. Within the fractionating column, the cracked products are separated into a plurality of fractionation streams including $H_2$, methane, higher alkanes, and olefins such as ethylene, propylene, butenes, which are recovered from the fractionating column as overheads or sidestreams, along with a bottoms product comprising tar and steam cracked gas oil (SCGO). Typically this residue material will have a boiling point above about 400° F. (It should be noted that boiling points given herein are to be taken at atmospheric conditions unless another pressure condition is indicated) This material is sent to the vacuum pipestill according to the present invention.

As shown in FIG. 1, described in more detail below, the annular structure 50 defines a ceiling which blocks upward passage of vapor/liquid mixtures along the circular wall beyond the ceiling section, and surrounds an open core having sufficient cross-sectional area to permit vapor velocity low enough to avoid significant entrainment of liquid. The use of an annular entrainment device in a distillation tower has been described in U.S. Pat. No. 4,140,212 and also U.S. Application Publication Nos. 2004/0004028; 2005/0261530; 2006/0089519; WO 2004/005431; and WO 2005/113715.

As noted, the feedstock to the pyrolysis furnace is a hydrocarbon. The most advantageous feedstock is one having non-volatile heavy ends, such as, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric resid, heavy residium, C4's/residue admixture, and naphtha residue admixture. The heavy hydrocarbon feedstock has a nominal end boiling point of at least 600° F. (310° C.). The preferred feedstocks are low sulfur waxy resids, atmospheric resids, and naphthas contaminated with crude. The most preferred is resid comprising 60-80% components having boiling points below 1100° F. (590° C.), for example, low sulfur waxy resids. After cracking in the furnace, the products are passed, optionally with quenching, to the primary fractionator, where various fractions are recovered, including the light olefins ethylene, propylene, and butenes, and a bottoms product comprising SCT, which is passed to the vacuum tower. A vacuum tower useful in the present invention is illustrated schematically in FIG. 1. The details not shown in FIG. 1, including trays, valves, and the like, would be immediately apparent to one of ordinary skill in the art in possession of the present invention. As shown in FIG. 1, annular ring 50 is of a size and shape sufficient to decrease the entrainment of liquid in the overheads or sidestream 40 from a device without the annular ring. The annular structure blocks upward passage of vapor/liquid mixtures along the circular wall due to vapor velocity, and surrounds an open core having sufficient cross-sectional area to permit vapor velocity low enough to avoid significant entrainment of liquid. The annular entrainment ring 50 and/or ceiling structure may be maybe of the type described in U.S. Pat. No. 4,140,212 or U.S. Appl. Publication Nos. 2004/0004028, 2005/0261530, 2006/0089519; or WO 2004/005431 or W02005/113715. To further increase the removal efficiency of the non-volatile hydrocarbons in the flash drum, it is preferred that the feedstock 20 from the primary fractionator downstream of the pyrolysis furnace enter the flash zone 12 tangentially through at least one tangential flash zone inlet (not shown). Preferably, the tangential inlets are level or slightly downward flow. The non-volatile hydrocarbon liquid phase will form an outer annular flow along the inside flash zone wall and the volatile vapor phase will initially form an inner core and then flow upwardly in the flash drum. The liquid phase is removed from one bottom flash zone outlet 30.

FIG. 1 illustrates two optional features, elements 14 and 16 which are, respectively, boot 14 which may be used to decrease liquid residence time in flash zone 12 so as to minimize asphaltene polymerization, and rectification zone 16 which may provide additional fractionation with or without additional distillation trays. These feature are per se known in the art in fractionators. Optionally, a side flash drum outlet or a vortex breaker (not shown) can be added to prevent a vortex forming in the outlet, as described in more detail in the aforementioned U.S. Pat. No. 4,140,212 or U.S. Appl. Publication Nos. 2004/0004028, 2005/0261530, 2006/0089519; or WO 2004/005431 or WO2005/113715, and likewise baffles (not shown in the present drawing but shown in detail in the aforementioned references) may also be installed inside the flash drum to further avoid and reduce any portion of the separated liquid phase, flowing downwards in the flash drum, from being entrained in the up flow vapor phase in the flash drum.

In preferred embodiments, the present invention relates to a vacuum pipestill having elements of a vapor/liquid separation apparatus for treating a flow of vapor/liquid mixtures of hydrocarbons and steam. The apparatus comprises (a) a substantially cylindrical vertical drum having an upper cap section, a middle section comprising a circular wall, and a lower cap section; (b) an overhead vapor outlet attached to the upper cap section; (c) at least one substantially tangentially positioned inlet in the circular wall of said middle section for introducing said flow along said wall; (d) an annular structure located in the middle section, comprising i) an annular ceiling section extending from the circular wall and ii) an internal vertical side wall to which the ceiling section extends, the side wall being positioned substantially concentrically to, but away from, the circular wall, the annular structure blocking the upward passage of the vapor/liquid mixtures along the circular wall beyond the ceiling section, and the annular structure surrounding an open core having sufficient cross-sectional area to permit vapor velocity low enough,to avoid significant entrainment of liquid; and (e) a substantially concentrically positioned, substantially cylindrical boot of less diameter than the middle section, the boot communicating with the lower cap section, and further comprising a liquid outlet at its lower end. In an embodiment, the apparatus further comprises: (f) optionally at least one baffle located at a lower part of the middle section providing a surface slanting downwardly from the center of the drum toward the circular wall and providing a gap between the baffle and the circular wall for directing liquid along or near the circular wall to the lower cap section.

In yet another aspect, the present invention relates to a process for cracking a hydrocarbon feedstock, the process comprising: (a) heating the hydrocarbon feedstock; (b) optionally mixing the heated hydrocarbon feedstock with a primary dilution steam stream to form a heated two-phase stratified open channel flow mixture stream, which may be further heated, e.g., by convection, prior to step (c); (c) optionally passing the heated feedstock from (a) and/or (b) to a vapor/liquid separation device integrated with the pyrolysis furnace; (d) optionally quenching the effluent of said pyrolysis furnace; (e) passing the effluent to a primary fractionator and recovering an overhead and/or sidestream comprising at least one light olefin selected from the group consisting of ethylene, propylene, and butene and a bottoms product comprising SCT; (f) passing said SCT to a vacuum pipestill comprising a vapor/liquid separation zone comprising an annular ring separating a flash zone from a distillation zone, more preferably wherein said vacuum pipestill comprising: (i) a substantially cylindrical vertical drum having an upper distillation section, a middle section comprising a substantially circular wall, and a lower flash zone; (ii) an overhead or sidestream vapor outlet attached to the upper distillation section; (iii) at least one substantially tangentially positioned inlet in the wall of the middle section for introducing the flow along the wall; (iv) an annular structure located in the middle section and separating said distillation section and said inlet in the wall of said middle section, the annular structure comprising A) an annular ceiling section extending from the circular wall and B) an internal vertical side wall to which the ceiling section extends, the side wall being positioned substantially concentrically to, but away from, the circular wall, the annular structure blocking the upward passage of the vapor/liquid mixtures along the circular wall beyond the ceiling section, and the annular structure preferably circumscribing an open core having sufficient cross-sectional area to permit vapor velocity low enough to avoid significant entrainment of liquid; and (v) an outlet in said lower flash zone for removing a heavy cut of deasphalted tar.

In preferred embodiments, the aforementioned mixture is blended with heavy fuel oils and/or Bunker fuels. Typical specifications are provided below for an RSFO blend meeting the 380 centistoke (cSt) requirements for Fuel Oil is given below. For a composition according to the present invention, the most important specifications (with regard to meeting the various specifications for published fuel oil requirements) are Kinematic Viscosity (KV), Specific Gravity (SG) and compatibility (e.g., one or both of the sediment criteria listed below). It is an important and surprising discovery of the present inventors that such specifications can be met for a mixture containing steam cracked tar.

One typical specification for a fuel oil is listed in Table 1.

TABLE 1

(RFSO) Standard Fuel Oil Specifications in Singapore (Platt's)

| Property | 380 cSt Fuel Oil |
|---|---|
| Sulfur Max | 4.0% |
| Kinematic Vis @50 deg C Max [ASTM D445] | 380 cSt |
| SG @15 C. deg C. Max | 0.991 |
| Flash Point Min | 66° C. |
| Pour Point Max | 24° C. |
| Ash on a weight basis Max | 0.10% |
| Conradson Carbon Residue (CCR) Max | 18% |
| Vanadium Max | 200 ppm |
| Sodium Max | 100 ppm |
| Aluminium + Silicon Max | 80 ppm |
| Water by distillation volume Max | 0.50% |
| Sediment by extraction Max | 0.10% |
| Total existent sediment | 0.10% |

Without wishing to be bound by theory, the present inventors believe have provided a novel process whereby tar obtained from chemical steam cracking apparatus may be upgraded using principles derived from refinery operations which, it is believed, have heretofore not been applied to low value products produced by steam crackers.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention.

The invention has been described above with reference to numerous embodiments and specific examples. Many variations will suggest themselves to those skilled in this art in light of the above detailed description. All such obvious variations are within the full intended scope of the appended claims.

What is claimed is:

1. A process for producing deasphalted steam cracker tar comprising feeding steam cracker tar to a vacuum pipestill (VPS) including a circular wall and a flash zone separated from a zone comprising distillation trays by at least one annular entrainment ring surrounding an open core having sufficient cross-sectional area to permit vapor velocity low enough to avoid significant entrainment of liquid in overheads, said annular entrainment ring comprising i) an annular ceiling section extending from the circular wall which blocks upward passage of vapor/liquid mixtures along the circular wall beyond the ceiling section; and ii) an internal vertical side wall to which the ceiling section extends, and obtaining as an overheads a deasphalted tar product and as a bottoms an asphaltenic heavy tar product.

2. The process of claim 1, wherein said VPS process conditions include a temperature of 700° F. -850° F. and a pressure of from about 0.5 to about 2 psia.

3. The process of claim 1, wherein said overheads comprise a cut having a boiling point of from about 550° F. to about 1000° F.

4. The process of claim 1, wherein said process further includes taking a side stream product.

5. The process of claim 1, wherein said deasphalted tar product is mixed with heavy fuel oils and/or Bunker fuels.

6. The process of claim 1, wherein said asphaltenic heavy tar product is passed to a POX or coker unit or burned.

7. The process of claim 1, comprising providing effluent from a pyrolysis furnace to a primary fractionator; and separating said effluent into at least one stream and bottoms product, wherein said bottoms product comprises said steam cracked tar.

8. The process of claim 7, wherein said asphaltenic heavy tar product is passed to a POX unit.

9. The process of claim 7, wherein said asphaltenic heavy tar product is passed to a coker unit.

10. The process of claim 7, comprising separating a feedstream in a vapor/liquid separation device that comprises an annular entrainment ring surrounding an open core having sufficient cross-sectional area to permit vapor velocity low enough to avoid significant entrainment of liquid in an overhead; and providing vapor phase via said overhead to said pyrolysis furnace.

11. A process for cracking a hydrocarbon feedstock, the process comprising:

(a) heating a hydrocarbon feedstock in a pyrolysis furnace;

(b) mixing the heated hydrocarbon feedstock with a primary dilution steam stream to form a heated mixture stream;

(c) passing said heated mixture stream to a vapor/liquid separation device integrated with the pyrolysis furnace;

(d) quenching the effluent of said pyrolysis furnace;

(e) passing the effluent to a primary fractionator and recovering an overhead and/or sidestream comprising at least one light olefin selected from the group consisting of ethylene, propylene, and butene and a bottoms product comprising steam cracked tar;

(f) passing said steam cracked tar to a vacuum pipestill comprising a vapor/liquid separation zone comprising an annular ring separating a flash zone from a distillation zone, wherein said vacuum pipestill comprising:

(i) a substantially cylindrical vertical drum having an upper distillation section, a middle section comprising a substantially circular wall, and a lower flash zone;

(ii) an overhead attached to the upper distillation section;

(iii) at least one substantially tangentially positioned inlet in the wall of the middle section for introducing the flow along the wall;

(iv) an annular structure located in the middle section and separating said distillation section and said inlet in the wall of said middle section, the annular structure comprising:

A) an annular ceiling section extending from the circular wall and

B) an internal vertical side wall to which the ceiling section extends, the side wall being positioned substantially concentrically to, but away from, the circular wall, the annular structure blocking the upward passage of the vapor/liquid mixtures along the circular wall beyond the ceiling section, and the annular structure preferably circumscribing an open core having sufficient cross-sectional area to permit vapor velocity low enough to avoid significant entrainment of liquid; and (v) an outlet in said lower flash zone for removing a heavy cut of deasphalted tar.

12. An integrated system comprising a pyrolysis furnace, a fractionation tower downstream of said pyrolysis furnace, and a vacuum pipestill downstream of said fractionation tower and fluidly connected with the bottoms of said fractionation tower, wherein said vacuum pipestill comprises a circular wall and flash zone separated from a zone comprising trays by an annular entrainment ring surrounding an open core having sufficient cross-sectional area to permit vapor velocity low enough to avoid significant entrainment of liquid in overheads, said annular entrainment ring comprising i) an annular ceiling section extending from the circular wall which blocks upward passage of vapor/liquid mixtures along the circular wall beyond the ceiling section; and ii) an internal vertical side wall to which the ceiling section extends.

13. The integrated system of claim 12, comprising a POX unit downstream of said vacuum pipestill that receives bottoms from the vacuum pipestill.

14. The integrated system of claim 12, comprising a coker unit downstream of said vacuum pipestill that receives bottoms from the vacuum pipestill.

15. The integrated system of claim 12, comprising a vapor/liquid separation device upstream of said pyrolysis furnace, said vapor/liquid separation device comprises an annular entrainment ring surrounding an open core having sufficient cross-sectional area to permit vapor velocity low enough to avoid significant entrainment of liquid in overheads.

* * * * *